US006397497B1

(12) United States Patent
McAtee

(10) Patent No.: US 6,397,497 B1
(45) Date of Patent: Jun. 4, 2002

(54) SHOE TONGUE ACCESSORY

(76) Inventor: Bradford McAtee, 252 Country Commons Rd., Cary, IL (US) 60013-2503

( * ) Notice: Subject to any disclaimer, the term of this patent is extended or adjusted under 35 U.S.C. 154(b) by 0 days.

(21) Appl. No.: 09/592,488

(22) Filed: Jun. 12, 2000

(51) Int. Cl.[7] ..... A43B 23/26; A43B 23/00
(52) U.S. Cl. ..... 36/54; 36/136; 383/90
(58) Field of Search ..... 36/1, 54, 100, 36/101, 136, 133, 137; 2/245; 383/90; 150/154, 158, 160, 161, 165

(56) References Cited

U.S. PATENT DOCUMENTS 601,192 A * 3/1898 Woodside ..... 36/54
1,640,665 A * 8/1927 Muscente ..... 36/136
1,974,721 A * 9/1934 Miller ..... 36/54
2,632,260 A * 3/1953 Herceg ..... 36/54
4,372,364 A * 2/1983 Katz ..... 150/154
4,458,738 A * 7/1984 Wilson ..... 150/154
4,805,321 A * 2/1989 Tonkel ..... 36/54
5,265,353 A * 11/1993 Marega et al. ..... 36/43
5,516,264 A * 5/1996 Anetrini ..... 416/62
5,566,477 A 10/1996 Manhs
5,673,499 A 10/1997 Attilieni
5,701,688 A 12/1997 Crowley
5,845,422 A 12/1998 Valteau

* cited by examiner

*Primary Examiner*—M. D. Patterson
(74) *Attorney, Agent, or Firm*—Basil E. Demeur; Alan B. Samlan

(57) ABSTRACT

A shoe tongue accessory that is designed for releasable attachment to the tongue of footwear to display a multitude of indicia or designs to alter the appearance of the footwear. The shoe tongue accessory consists of a first fragment and a second fragment that coact to form a pouch which is designed to receive the tongue of the footwear. The pouch is secured to the tongue through the combination of a strap affixed on the first fragment and at least two strap fasteners affixed on the second fragment. This combination permits the strap fasteners to engage the straps and secure the tongue within the pouch. The first fragment and the second fragment each display different indicia or designs and the pouch is further designed to permit the wearer to reverse the indicia or designs as desired.

4 Claims, 2 Drawing Sheets

SHOE TONGUE ACCESSORY

I. FIELD OF THE INVENTION

The present invention relates to footwear and, more particularly, to a removable and reversible covering accessory for the tongue of a shoe that is capable of displaying an infinite variety of indicia or designs, or combinations thereof, to alter the appearance of the shoe as desired.

II. DESCRIPTION OF THE PRIOR ART

Footwear today has become a popular avenue to display artistic style and impressions, exude fanciful colors and designs, and even present trademarks or logos of the manufacturers. Various patents have issued for devices that provide for the attachment of decorations or that provide for alteration of appearances of footwear.

For example, in U.S. Pat. No. 5,845,422 to Valteau, III, entitled "Decorative Attachment For Footwear" a decorative shoe shield is disclosed. The decorative shoe shield is suitable for detachable positioning and securing to the shoelaces of an article of footwear. The shoe shield contains a plurality of openings formed in the body of the shoe shield to receive the shoelaces such that, upon the tightening of the shoelaces, the shoe shield becomes securely connected to the footwear. The top surface of the shoe shield is adapted to receive decorative indicia imprinted thereon. A shortcoming of this device is that the decorative shoe shield is required to be secured to the shoelaces of the footwear. The usefulness of this decorative shoe shield is, therefore, not adaptable for footwear that does not contain shoelaces. Another shortcoming is that the application and securing of the device to the shoelaces is time consuming and potentially cumbersome. Still another shortcoming is that the shoe shield contains only one decoration. Thus, to obtain a different appearance through the display of a different decoration requires a second shoe shield.

Another example is U.S. Pat. No. 5,566,477 to Mathis et al. entitled "Removable Shoelace Cover For A Shoe" which discloses a cover that is positioned over the top of the shoelaces of footwear, such as a gym shoe. The cover is secured to the shoe by a number of straps attached to the shoe that are threaded through slots provided in the cover. The cover incorporates an interchangeable fashion panel that is separately secured to the top of the cover. An inherent shortcoming of this patent is that the device requires three separate pieces to display the fashion panel on footwear: the straps, the cover, and the fashion panel. Another shortcoming of this device is that the straps are required to be attached to the shoe. Thus, if the cover is not attached to shoe, the shoe and its appearance is burdened by the attachment of useless straps. Still another shortcomning is that the fashion panel is separately secured to top of the cover and, therefore, the fashion panel is susceptible to being accidentally moved into undesirable viewing positions or pulled from the shoe altogether. Still another shortcoming is that the fashion panel contains the decoration on one side and an adhering means on the other. As a result, this device is not capable of providing a completely different fashion statement on the other side and, therefore, is not reversible.

Likewise, another patent that suffers from the inherent shortcomings of the previous patent is U.S. Pat. No. 5,701,688 to Crowley entitled "Protective Shoelace Cover". This patent discloses another shoelace cover that is detachably secured to the upper portion of a shoe which is provided with mating fasteners permanently adhered to the exterior of the shoe. The shoelace cover is provided with a translucent window to permit the shoelaces to be seen, particularly if the shoelaces are of different colors, and to provide a medium within the shoelace cover to provide a decorative emblem or feature. In addition to the shortcomings previously enumerated, although this patent eliminates one piece from the previous patent to display the decoration on footwear, it still requires the use of two separate pieces: the mating fasteners on the shoe and the shoelace cover.

To eliminate many of the shortcomings provided by the shoelace covering patents, several patents have been issued for the display of decoration on the tongue of the footwear. For example, in U.S. Pat. No. 5,673,499 to Attilieni entitled "Footwear Tongue With Removable Decorative Element" a tongue is provided with a housing to secure an engageable and disengageable decorative element. The housing also encloses a light emission apparatus positioned below the decorative element. The apparatus is activated by the walking of the wearer and the decorative element is made of transparent material to emit the light and, thereby, view the decoration. An inherent problem with this device is that the housing is permanently manufactured into the tongue. As a result, the decorative element can never be removed from the shoe. Another problem is that if the decorative element is removed or lost and is not replaced by another decorative element, the shoe becomes an eye soar as the light emission apparatus is constantly exposed and emitting an unpleasant light absent a decoration. Still another problem is that the decorative element of the tongue does not permit the reversibility of designs within a single element.

The reversible problem of the tongue for footwear is solved by U.S. Pat. No. 4,805,321 to Tonkel entitled "Reversible Shoe Tongue". This patent discloses a tongue that is reversible at the selection of the wearer to provide a selection of two sides which may bear individual displays or indicia. A shortcoming of this design is that the wearer is limited to two designs only: the selection of the design on one side and the selection of the design on the other side. If the wearer desired to display any other type of design, the wearer must purchase another shoe. Another shortcoming is that the design selections and the tongue are manufactured as an integral unit with the footwear. As a result, the wearer does not have the capability to wear the footwear without the design, if desired.

Thus, there is a need and there has never been disclosed a shoe tongue accessory that is releasably secured to the tongue of a shoe and which provides reversible capabilities to display a multiplicity of indicia or designs.

III. OBJECTS OF THE INVENTION

It is the primary object of the present invention to provide a shoe tongue accessory that is provided with a multiplicity of indicia or designs. A related object of the present invention is to provide an accessory with reversible characteristics. Still another related object of the present invention is to provide a wearer with the capability to alter the appearance of the footwear as desired.

Another related object of the present invention is to provide a shoe tongue accessory that is easily secured and removable from the tongue of the footwear. A related object of the invention is to provide a convenient means to attach the accessory to the footwear.

Still another object of the present invention is to provide a shoe tongue accessory that is adaptable to various sizes and shapes of all footwear and different manufacturers.

Other objects of the present invention will become more apparent to persons having ordinary skill in the art to which the present invention pertains from the following description taken in conjunction with the accompanying drawings.

IV. SUMMARY OF THE INVENTION

The present invention is a shoe tongue accessory that is designed for releasable attachment to the tongue of footwear and is capable of displaying a multitude of indicia or designs to alter the appearance of the footwear. The shoe tongue accessory consists of a first fragment and a second fragment that coact to form a pouch which is designed to receive the tongue of the footwear. The pouch is secured to the tongue through the combination of a strap affixed on the first fragment and strap fasteners affixed to the second fragment. This combination permits the strap fasteners to engage the straps and secure the tongue within the pouch. The first fragment and the second fragment each display different indicia or designs such that the wearer is permitted to reverse the indicia or designs as desired.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
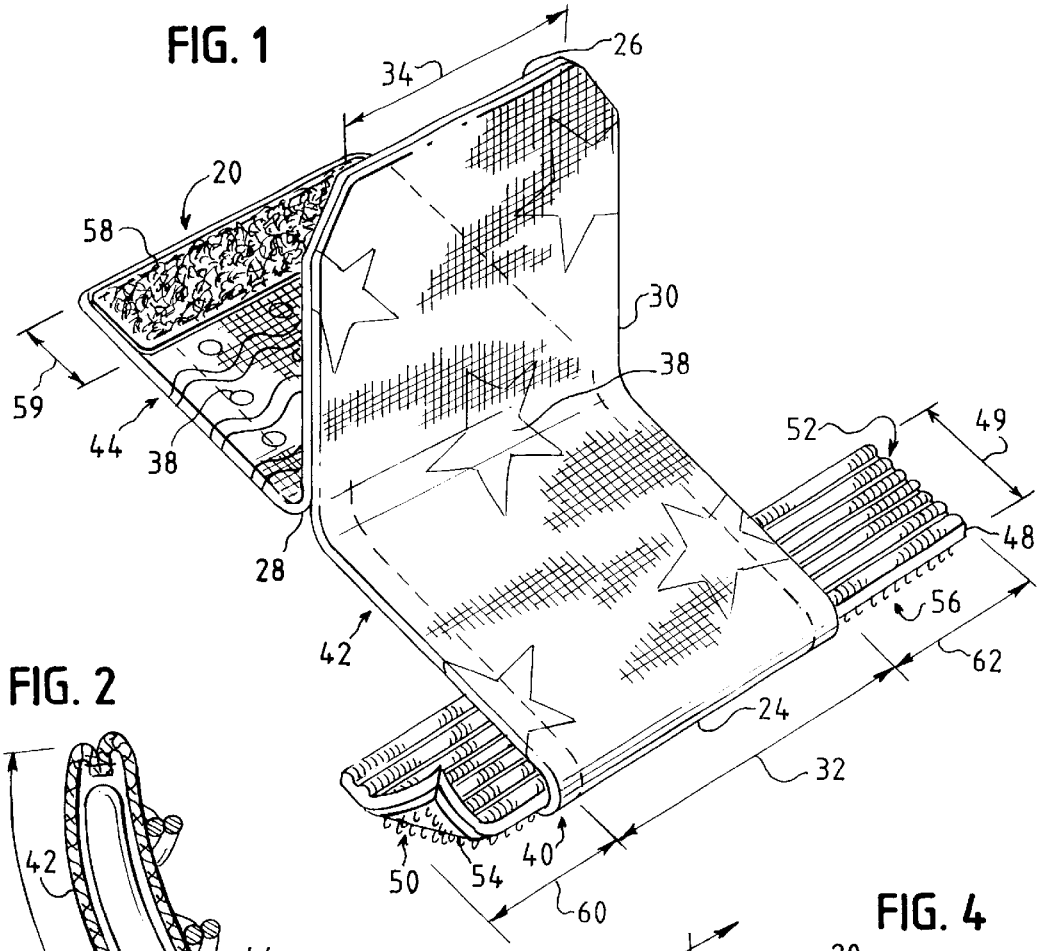
FIG. 1 is a perspective view of the shoe tongue accessory prior to attachment to the tongue of the footwear.
Figure 2:
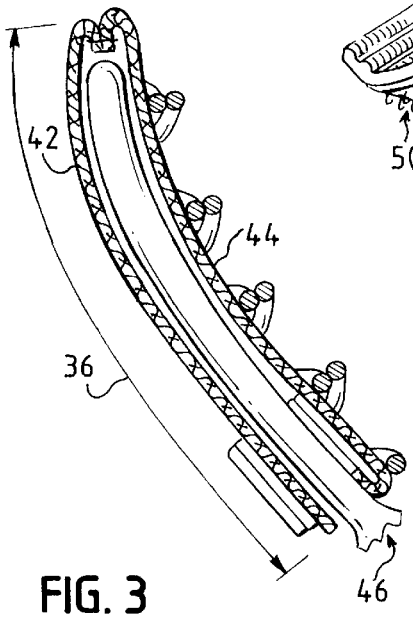
FIG. 2 is a side view of the inventive device of FIG. 1 illustrating the respective sides that form the pouch of the device.

Turning first to FIG. 1, there is illustrated a shoe tongue accessory 20. The shoe tongue accessory 20 has a body 22 with a top 24, a bottom 26, and sides 28 and 30. The top 24 has a top width 32 and the bottom 26 has a bottom width 34. In the preferred embodiment, the top width 32 is slightly smaller than the bottom width 34. The difference in widths permits a more tailored fit of the body 22 to the tongue of the footwear. The body 22 has a body length 36 (FIG. 2). Preferably, the body length 36 and the top width 32 and bottom width 34 are the approximate length and width of a tongue for footwear. The body length 36 is variable depending upon the type and size of the footwear. For example, children's footwear requires less of the body length 36 than an adult's footwear as the tongue is smaller. The top width 32 and bottom width 34 are also variable depending upon the size of the footwear. For example, one foot may be narrow in which case the footwear will have a tongue that has a smaller width to accommodate the narrower foot. In this instance, the top width 32 and bottom width 34 will likewise approximate the narrower tongue. In another example, such as for flat feet, the tongue will be required to have a larger width to accommodate the larger foot. In that instance then, the top width 32 and bottom width 34 will likewise be larger to accommodate the larger tongue.

Preferably, the body 22 is adaptable to any type of tongue for any type of footwear. Such footwear includes but is not limited to athletic shoes, tennis shoes, basketball shoes, football shoes, hockey shoes, training shoes, cross-country shoes, sailing shoes, tap shoes, ski boots, snow boarding boots, hiking boots, climbing shoes, and children's shoes, and baby shoes.

The body 22 is made of a flexible type material that is capable of expanding and contracting to receive a tongue of footwear. Preferably, the body 22 also has sufficient tensile strength to withstand the elements and repeated use on footwear. In the preferred embodiment, the body 22 is made of a stretchable encapsulating material that consists of various elastic textile fibers made chiefly of polyurethane. This material is referred to as and commonly sold under the name of spandex. Alternatively, it is contemplated that other similar materials may be used provided the material is flexible and durable enough to withstand use as a covering for a tongue of the footwear and to display designs thereon.

The body 22 has a design 38 imprinted on the exterior of the body 22. Alternatively, the design 38 may be bonded, stitched, or applied in any other manner to the body 22 provided it effectively retains the design 38. The design 38 may be any type of design such as graphical designs, artistic shapes and/or patterns. The design 38 may also include any type of color or combinations of colors. Alternatively, the design 38 may incorporate or illustrate various types of indicia such as emblems, logos, trademarks, insignias, and the like. It is also contemplated that the design 38 may emulate those of sport teams, cartoon characters, or any other emulation for which a wearer might have an interest or receive enjoyment therefrom.

The body 22 consists of a first fragment 42 and a second fragment 44. The first fragment 42 is approximately the same size as the second fragment 44. The body 22 is formed by the attachment of the first fragment 42 to the second fragment 44. Preferably, the first fragment 42 is attached to the second fragment 44 along the bottom 26 and sides 28 and 30. In the preferred embodiment, the first fragment 42 is attached to the second fragment 44 by stitching. Alternatively, any other form of attachment is acceptable provided the attachment is strong enough to withstand repeated use. This attachment between the first fragment 42 and the second fragment 44 forms the pouch to receive the tongue of the footwear by closing the bottom 26 of the body 22 and creating an opening 46 (See FIG. 2) in the top 24 of the body 22.

The body 22 has a fastening means 38 attached to the top 24 of the body 22. The fastening means 40 consists of an elastic band 48 with ends 50 and 52 that contain strap fasteners 54 and 56, respectively, and a reciprocating strap 58 for the strap fasteners 54 and 56. The fastening means 38 and reciprocating strap 58 coact as the securing means for the shoe tongue accessory 20. The elastic band 48 is situated along the top 24 of the second fragment 44 of the body 22. The elastic band 48 is aligned parallel with the top 24 and perpendicular to the sides 28 and 30 of the body 22. The elastic band 48 has a band width 49. The ends 50 and 52 of the elastic band 48 extend outwardly from the body 22 and have an end width 60 and 62, respectively. Preferably, the end width 60 is approximately equal to the end width 62. In the preferred embodiment, the top width 32 is larger than the aggregate of the end widths 60 and 62 to permit proper securement of the body 22 about the tongue of the footwear and to prevent unnecessary bulging or overlapping of strap fasteners 54 and 56, discussed in further below.

Figure 3:
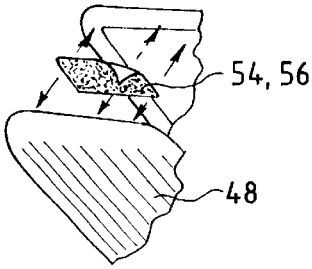
FIG. 3 is an exploded perspective view of the attachment of the strap fasteners to the body of the shoe tongue accessory.

Ends 50 and 52 are each provided with strap fasteners 54 and 56 for attachment to the strap 58 and, thereby, enable the shoe tongue accessory 20 to be secured to the tongue of the footwear. In the preferred embodiment, strap fasteners 54 and 56 are made of a fabric that consists of a plurality of small hooks that stick to or attach to a corresponding fabric of small loops. This type of material is referred to as and commonly sold under the trademark Velcro®. Alternatively, hook and loop tape or any other form of engagement may be used to attach strap fasteners 54 and 56 to the strap 58 provided the attachment effectively secures the shoe tongue accessory 20 to the tongue. The strap fasteners 54 and 56 are preferably attache d to the ends 50 and 52 of the elastic band 48 by stitching as depicted in FIG. 3. Alternatively, the strap fastener s 54 and 56 may be attached to the ends 50 and 52 by any other means that provides a fastening means 40 which is effectively secured to the strap 24 to enable the shoe tongue accessory 20 to the tongue of footwear.

The strap 58 is situated along the top 24 of the first fragment 42 of the body 22. The strap 58 is aligned parallel with the top 24 and perpendicular to the sides 28 and 30 of the body 22. The strap 58 has a strap width 59. Preferably, the strap width 59 is approximately equal to the band width 49 to permit the maximum amount of securement between the fastening means 40 and the strap 58. Preferably, the strap 58 is also aligned parallel to the fastening means 40 to provide easier attachment as -discussed in further detail below.

Figure 4:
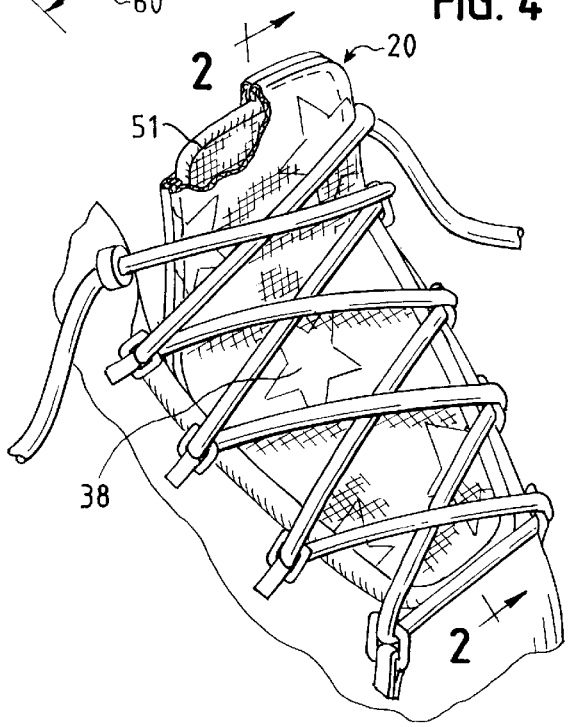
FIG. 4 is a perspective view of the inventive device as assembled to the tongue of footwear.
Figure 5:
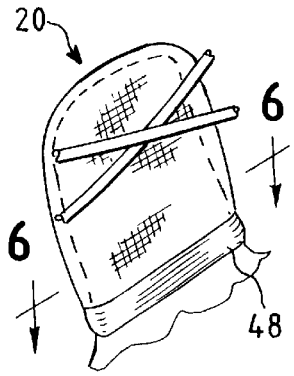
FIG. 5 is a perspective view of the inventive device illustrating the attachment of fastening means to the strap.

Referring to FIG. 4, the shoe tongue accessory 20 as properly assembled to the tongue 51 of the footwear is illustrated. To secure the shoe tongue accessory 20 to the tongue 51 of footwear, the body 22 of the shoe tongue accessory 20 is traversed around the tongue 51 such that the tongue 51 is received into the opening 46 in the top 24 of the body 22, between the first fragment 42 and the second fragment 44. The tongue 51 is continued to be received within the body 22 until the top of the tongue 51 reaches the bottom 26 of the body 22. Once the tongue 51 reaches the bottom 26 of the body 22, the first fragment 42 and the second fragment 44 are situated on opposed sides of the tongue 51. The first fragment 42 may be positioned on the top of the tongue 51 and, thereby, the design 38 of the first fragment 42 is exposed to the visibility of the wearer and the second fragment 44 will be positioned on the bottom of the tongue 51 adjacent to and in contact with the top of the foot of the wearer. Alternatively, the second fragment 44 may be positioned on the top of the tongue 51 to, thereby, expose the design 38 of the second fragment 44 to the visibility of the wearer and the first fragment 42 will then be correspondingly positioned on the bottom of the tongue 51 adjacent to and in contact with the top of the foot of the wearer. In either instance, the first fragment 42 and the second fragment 44 are stretched such that the exterior surface of the first fragment 42 and the second fragment 44 are in a straight and smooth position. In this position, the strap 58 of the first fragment 42 and the portion of the elastic band 48 between the ends 50 and 52 of the second fragment 44 are aligned in the center of the tongue 51 of the footwear to effectively secure the shoe tongue accessory 20 to the tongue 51 in the form as illustrated in FIG. 5.

Figure 6:
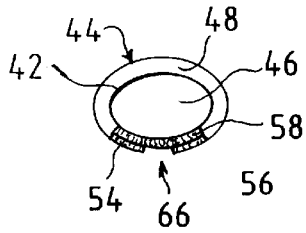
FIG. 6 is a top view of the inventive device, taken along 6—6 of FIG. 5, more clearly depicting the assembly of the securing means.

In FIG. 6, the shoe tongue accessory 20 is secured to the tongue 51 by rotating and folding the ends 50 and 52 around the outside of the tongue 45 such that the strap fasteners 54 and 56 may be firmly pressed upon the strap 58 and, thereby, permit the strap fasteners 54 and 56 to be adhered to the strap 58. The elastic band 48 may be stretched to accommodate a tighter and more secure fit of the body 22 around the tongue 51 by adhering the full end width 60 and 62 of strap fasteners 54 and 56 directly to the strap 58. Upon the full width of strap fasteners 54 and 56 being adhered to strap 58, a gap 66 is created between strap fastener 54 and strap fastener 56. Preferably, the gap 66 is any width such that some distance separates strap fastener 54 and strap fastener 56 to prevent overlapping.

Upon the attachment of the shoe tongue accessory 20 to the tongue 51 of the footwear, the design 38 of the first fragment 42 becomes exposed and visible to the wearer. Alternatively, the shoe tongue accessory 20 may be removed and reattached to the tongue 51 of the footwear such that the design 38 of the second fragment 44 is exposed and visible to the wearer. In this manner, the shoe tongue accessory 20 is reversible to the wearer.

Figure 7:
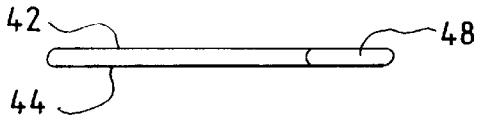
FIG. 7 is a side elevational view of the inventive device in a slit configuration.

Alternatively, it is contemplated that the fastening means 40 may consist solely of one continuous elastic band 48 as depicted in FIG. 7. In this alternate embodiment, the body 22 does not contain a strap 58, strap fasteners 54 and 56, or ends 50 and 52. Instead, the shoe tongue accessory 20 is formed into a single body 22 that is closed on one end and is provided with an elastic band 48 that is integrally formed into the top 24 of the first fragment 42 and the second fragment 44 to create a permanent opening 46 that may be expanded to traverse and receive the tongue of the footwear and released to constrict the elastic band 48 around the tongue to secure the body 22 to the tongue of the footwear. The shoe laces may also provide additional securement of the body 22 to the tongue upon the tightening of the shoe laces about the tongue.

Figure 8:
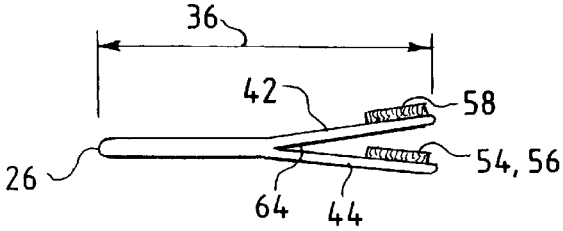
FIG. 8 is a side elevational view of an alternate embodiment of the inventive device in a full configuration.
Figure 9:
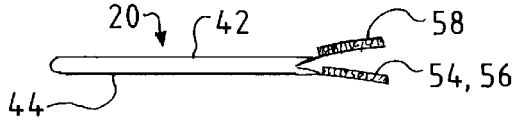
FIG. 9 is a side elevational view of a second alternate embodiment of the inventive device in a full configuration.

FIGS. 8 and 9 illustrate alternate embodiments of the attachment of the first fragment 42 to the second fragment 44 to form the pouch. In FIG. 8, the first fragment 42 is attached to the second fragment 44 from the bottom 26 up to approximately the center of the body length 36 such that the first fragment 42 then diverges from the second fragment 44 into a Y shape or slit 64. This embodiment with the Y shape or slit 64 permits the shoe tongue accessory 20 to be secured to footwear manufactured by, for example, the Nike® Company. The Nike® type shoes have a tongue which is provided with a band located in the center of and perpendicular to the tongue which holds the tongue in position within the footwear. The Y shape or slit 64 permits the body 22 of the shoe tongue accessory 20 to be traversed over and to receive the top portion of the tongue up to the band which will be directed into and slightly wedged within the Y shape or slit 64 of the body 22. In footwear that does not contain the band as described for Nike® type shoes, the straight embodiment of FIG. 9 is preferable. In this embodiment, the Y shape or slit 64 of FIG. 8 is removed and the first fragment 42 is attached to the second fragment 44 along the entire body length 36 until the attachment approximately reaches the strap 58 and strap fasteners 54 and 56.

Figure 10:
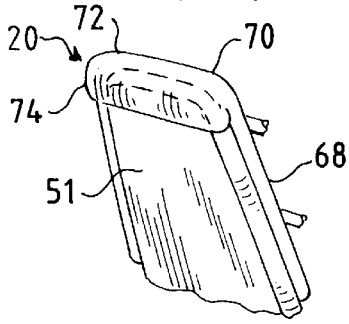
FIG. 10 is a an alternate embodiment of the inventive device.

Turning to FIG. 10, an alternate embodiment of the shoe tongue accessory 20 is illustrated. The body 22 of the shoe tongue accessory 20 may consist of a single fragment 68. The single fragment 68 has a top side 70, an underside 72 (not illustrated), and a pocket 74. The pocket 74 is located at the end of the body 22 to receive the top of the tongue 45 such that upon the insertion of the shoe tongue accessory 20 between the top of the tongue 45 and the shoelaces, the tongue 45 is received into the pocket 74. The pocket 74 is dimensioned to be slightly larger than the tongue 45 of the shoe to be frictionally engage the tongue 45 and permit easy attachment of the shoe tongue accessory 20 to the tongue 45. The pocket 74 acts to secure the single fragment 68 to the shoe. Upon attachment to the shoe, the tightening of the shoelaces by the wearer coacts with the pocket 74 to further secure the shoe tongue accessory 20 to the shoe.

The shoe tongue accessory 20 provides the design 38 on the top side 70 facing the shoelaces and the wearer and on the underside 72 adjacent to the tongue 45. It is contemplated that the pocket 74 may be folded inside out such that the pocket exterior 76 becomes the base of the pocket 74. Upon the folding of the pocket 74, the top side 70 and underside 72 become reversed such that the top side 70 now becomes the underside of the shoe tongue accessory 20 and the underside 72 now becomes the topside of the shoe tongue accessory 20. In this manner, the shoe tongue accessory 20 retains its reversability and enables the design 38 on either the top side 70 or the underside 72 to be displayed as desired by the user.

Thus, there has been provided a shoe tongue accessory that is releasably secured to the tongue of footwear and provides the wearer with the reversible versatility to display a multitude of designs for the footwear. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A decorative reversible cover for a shoe tongue adapted for displaying a decorative indicia on the top surface of a shoe tongue, comprising:

a pouch having a first fragment and a second fragment, having a top, a bottom, and two sides separated by an opposed interior and exterior surfaces, the second fragment having a top, a bottom and two sides separated by an opposed interior and exterior surfaces, the two sides and the bottom of the interior surface of the first fragment being affixed to the two sides in the bottom of the interior surface of the second fragment to form a pouch therebetween with a closed end and an open end, the closed end forming a complete and flat seal between the first fragment and the second fragment along the entire bottom and between the two sides of each fragment so that the closed end of the pouch acts as a stopping means for the tongue when the pouch is in use, the pouch further defining a pouch length between the closed end and the open end, the pouch length being approximately equal to the length of the tongue of the footwear, a decorative design displayed on the exterior surface of the both the first fragment and the second fragment, an elastic band affixed along the top of the interior surface of the second fragment and perpendicular to the two sides of the sides of the second fragment, the elastic band having a first end and a second end extending outwardly from the two sides of the second fragment, at least two strap fasteners adhere to the first end and the second end respectively, the strap fasteners located on the first end and the second end respectively facing in the direction of the first fragment, a strap affixed along the top of the exterior surface of the first fragment, said two strap fasteners and said strap affixed along the exterior surface of the first fragment co-acting to secure said pouch to a shoe tongue when in use in a flat disposition to prevent bulging of said strap fasteners when in the secured position in use over the tongue of the footwear, whereby the strap fastener of the first end and the strap fastener of the second end may be folded and adhered to the strap affixed to the top of the exterior surface of the first fragment to attach the second fragment to the first fragment to secure the pouch to a tongue of the footwear upon the tongue being inserted into and received by the open end of the pouch between the first fragment and the second fragment.

2. The accessory of claim 1 wherein the first fragment and the second fragment are made of a flexible and durable material.

3. The accessory of claim 2 wherein the flexible material of the first fragment and the second fragment is made of polyurethane.

4. The accessory of claim 1 wherein the strap fasteners are made of a plurality of small hooks and the strap is made of a corresponding reciprocating fabric of small loops.

* * * * *